US009970385B2

(12) United States Patent
Maki et al.

(10) Patent No.: US 9,970,385 B2
(45) Date of Patent: May 15, 2018

(54) COMPOSITE CYLINDER BLOCK FOR AN ENGINE

(71) Applicant: Ford Global Technologies, LLC, Dearborn, MI (US)

(72) Inventors: Clifford E. Maki, New Hudson, MI (US); Rick L. Williams, Canton, MI (US); Robert Gordon Rentschler, Dearborn, MI (US); Stefan Quiring, Leverkusen NRW (DE)

(73) Assignee: Ford Global Technologies, LLC, Dearborn, MI (US)

( * ) Notice: Subject to any disclaimer, the term of this patent is extended or adjusted under 35 U.S.C. 154(b) by 65 days.

(21) Appl. No.: 14/714,769

(22) Filed: May 18, 2015

(65) Prior Publication Data

US 2016/0341148 A1 Nov. 24, 2016

(51) Int. Cl.
*F02F 7/00* (2006.01)
*F02F 1/00* (2006.01)

(52) U.S. Cl.
CPC ..... *F02F 7/0058* (2013.01); *F02F 1/004* (2013.01)

(58) Field of Classification Search
CPC ..... F02F 7/0085; F02F 1/004
USPC ..... 123/193.2
See application file for complete search history.

(56) References Cited

U.S. PATENT DOCUMENTS 4,446,827 A * 5/1984 Kubozuka ..... F02F 7/0007 123/193.2
4,630,579 A * 12/1986 Atkin ..... F02F 7/0053 123/195 H
4,848,292 A 7/1989 Holtzberg
5,375,569 A 12/1994 Santella
5,429,080 A * 7/1995 Pong ..... F01B 1/12 123/195 R
6,044,819 A 4/2000 Rivers et al.
6,076,494 A * 6/2000 Kampichler ..... F02F 7/0058 123/193.3
8,061,324 B2 11/2011 Dauphin
2006/0081210 A1* 4/2006 Kajiwara ..... F02F 7/0012 123/195 H (Continued)

FOREIGN PATENT DOCUMENTS

EP 1398491 A1 3/2004
WO WO2013108277 * 1/2012 ..... F02F 7/0058

OTHER PUBLICATIONS http://www.greencarcongress.com/2014/06/20140618-mmlv.html, "Green Car Congress: The technology behind Ford's Lightweight Concept Vehicle; prospects for Mach-II with 50% mass reduction difficult", Aug. 21, 2014, 9 pages.

(Continued)

*Primary Examiner* — Joseph Dallo
*Assistant Examiner* — Yi-Kai Wang
(74) *Attorney, Agent, or Firm* — Brooks Kushman P.C.; Julia Voutyras

(57) ABSTRACT

A cylinder block for an engine includes a first composite portion having a first surface adjacent to a first recess, a second composite portion having a second surface adjacent to a second recess, and a cylinder liner received by the first and second recesses and positioned between the first and second portions. The first surface is adapted to mate with the second surface along a plane extending through the cylinder liner.

20 Claims, 7 Drawing Sheets

(56) References Cited

U.S. PATENT DOCUMENTS

| | | | | |
|---|---|---|---|---|
| 2006/0102110 | A1* | 5/2006 | Takenaka | F02F 7/0021 123/41.82 A |
| 2006/0167844 | A1* | 7/2006 | Srinivas | G06Q 10/06 |
| 2008/0245334 | A1* | 10/2008 | Omura | F02F 1/10 123/193.3 |
| 2011/0030627 | A1* | 2/2011 | Bing | B22D 19/0009 123/41.79 |
| 2012/0255516 | A1* | 10/2012 | Diggs | F01B 9/026 123/195 C |

OTHER PUBLICATIONS

Skszek et al., "Multi-Material Lightweight Vehicles: Mach-II Design", Project ID#LM088, Jun. 17, 2014, 27 pages.

Guimond et al., "Composite V-6 Diesel Engine Concept", SAE International, International Congress & Exposition, Detroit, MI, Feb. 24-28, 1992, 8 pages.

http://blog.caranddriver.com/is-this-the-engine-of-the-future-in-depth-with-matti-holtzberg- . . . , "Is This the Engine of the Future: In-Depth with Matti Holtzberg and His Composite Engine Block", May 6, 2011, 4 pages.

* cited by examiner

COMPOSITE CYLINDER BLOCK FOR AN ENGINE

TECHNICAL FIELD

Various embodiments relate to a composite cylinder block for an internal combustion engine.

BACKGROUND

A conventional cylinder block for an internal combustion engine is often formed from a metal or metal alloy in a process often referred to as mono-block casting. In a mono-block casting, the cylinder block is formed as a single molding and solidifies as one free standing casting in a process such as sand casting or die casting. Recently, in an effort to reduce weight, forming the cylinder block of the engine from a composite material has been explored. Issues exist for forming a composite cylinder block as a mono-block casting due to different cure rates for various thicknesses in the block, different rates of thermal expansion between the composite material and any block inserts, and the difficulty in forming complex internal shapes.

SUMMARY

In an embodiment, a cylinder block is provided with a first composite panel having a first surface adjacent to a first recess, a second composite panel having a second surface adjacent to a second recess, and a cylinder liner received by the first and second recesses and positioned between the first and second panels. The first surface is adapted to mate with the second surface along a plane extending through the cylinder liner.

In another embodiment, a method of forming a composite cylinder block is provided. Adhesive is applied to a first surface and a portion of a first recess adjacent to the first surface of a first composite panel. Adhesive is applied to a portion of a second recess adjacent to the second surface of a second composite panel. A cylinder liner is positioned between the first and second composite panels. The first and second composite panels are coupled to one another such that the cylinder liner is received by the first and second recesses, the first surface mates with the second surface, and the portion of the first recess and the portion of the second recess mates with the liner.

In yet another embodiment, an engine is provided with a cylinder block having first and second opposed composite side panels supporting a ganged cylinder liner forming adjacent cylinder bores along a longitudinal axis of the block. The first and second side panels mate along a plane extending through the cylinder liner. The first and second side panels cooperate to define a deck face of the block and fluid passages within the block.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
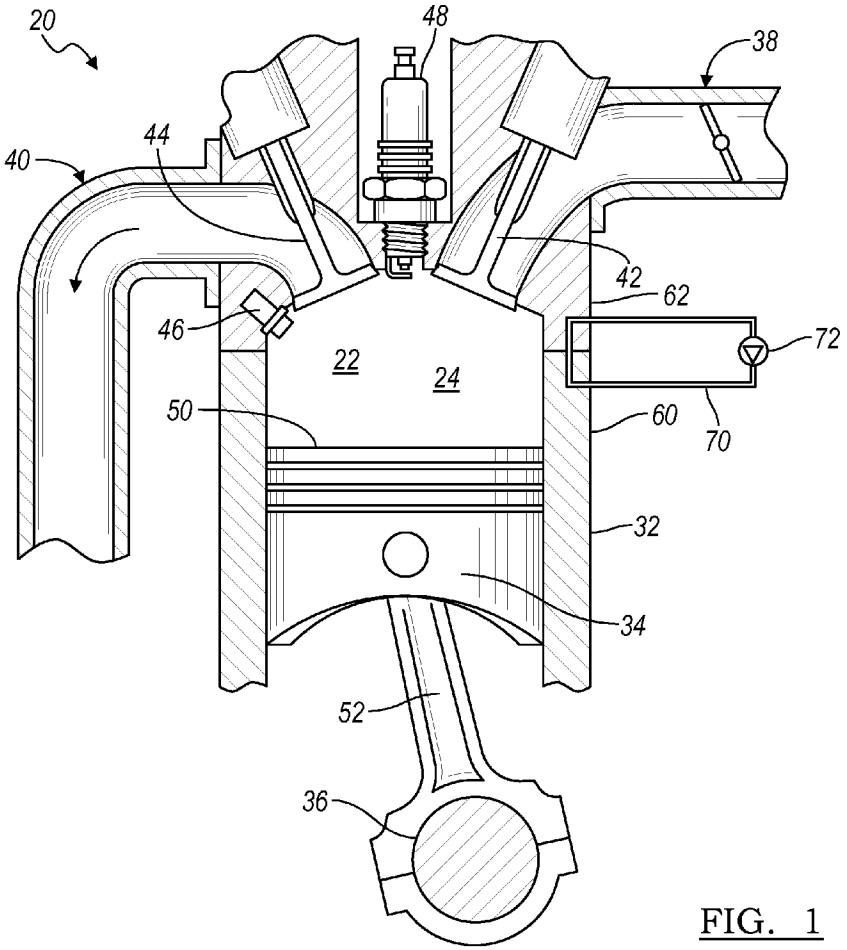
FIG. 1 illustrates a schematic of an internal combustion engine configured to implement the disclosed embodiments.

FIG. 1 illustrates a schematic of an internal combustion engine 20. The engine 20 has a plurality of cylinders 22, and one cylinder is illustrated. The engine 20 may include multiple cylinders arranged in various manners, including an inline configuration and a V-configuration. The engine 20 has a combustion chamber 24 associated with each cylinder 22. The cylinder 22 is formed by cylinder walls 32 and a piston assembly 34. The piston assembly 34 is connected to a crankshaft 36. The combustion chamber 24 is in fluid communication with the intake manifold 38 and the exhaust manifold 40. An intake valve 42 controls flow from the intake manifold 38 into the combustion chamber 30. An exhaust valve 44 controls flow from the combustion chamber 30 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 30. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 operates under a four-stroke cycle including an intake stroke, a compression stroke, an ignition stroke, and an exhaust stroke. In other examples, the engine may operate using a two-stroke cycle. During the intake stroke, the intake valve 42 opens and the exhaust valve 44 closes while the piston assembly 34 moves from the top of the cylinder 22 to the bottom of the cylinder 22 to introduce air from the intake manifold to the combustion chamber. The piston assembly 34 position at the top of the cylinder 22 is generally known as top dead center (TDC). The piston assembly 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston assembly 34 causes a corresponding movement in crankshaft 36 and provides for a mechanical torque output from the engine 20. The combustion process causing the expansion stroke results in loads and forces on the engine 20. A force on the engine caused by the combustion event in the chamber 24 imparts a force on the face 50 of the piston 34, and at least a portion of the force travels down the connecting rod 52 to the main bearing and crankshaft 36. This force on the main bearing may be referred to as a reactive force. The combustion event within the chamber 24 also causes a force on the cylinder head 62, which loads attachment points, such as head bolts, between the engine head 62 and a cylinder block 60. The force on the cylinder head and head bolts may be referred to as a combustion force.

During the exhaust stroke, the intake valve 42 remains closed, and the exhaust valve 44 opens. The piston assembly 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 may have a cylinder block 60 that forms the cylinders 22. A cylinder head 62 is connected to the block 60. The head 62 encloses the combustion chamber 24 and also supports the various valves 42, 44, and intake and exhaust systems 38, 40. A head gasket or another sealing member may be positioned between the block 60 and the head 62 to seal the combustion chamber 24.

A fluid circuit 70 may also be provided in the engine 20 with fluid passages in the block 60 and/or the head 62 to provide a flow of fluid, such as coolant or lubricant, through the engine for cooling and/or lubrication. The fluid circuit may also include a reservoir and a pump 72, valves, and other devices.

Figure 2:
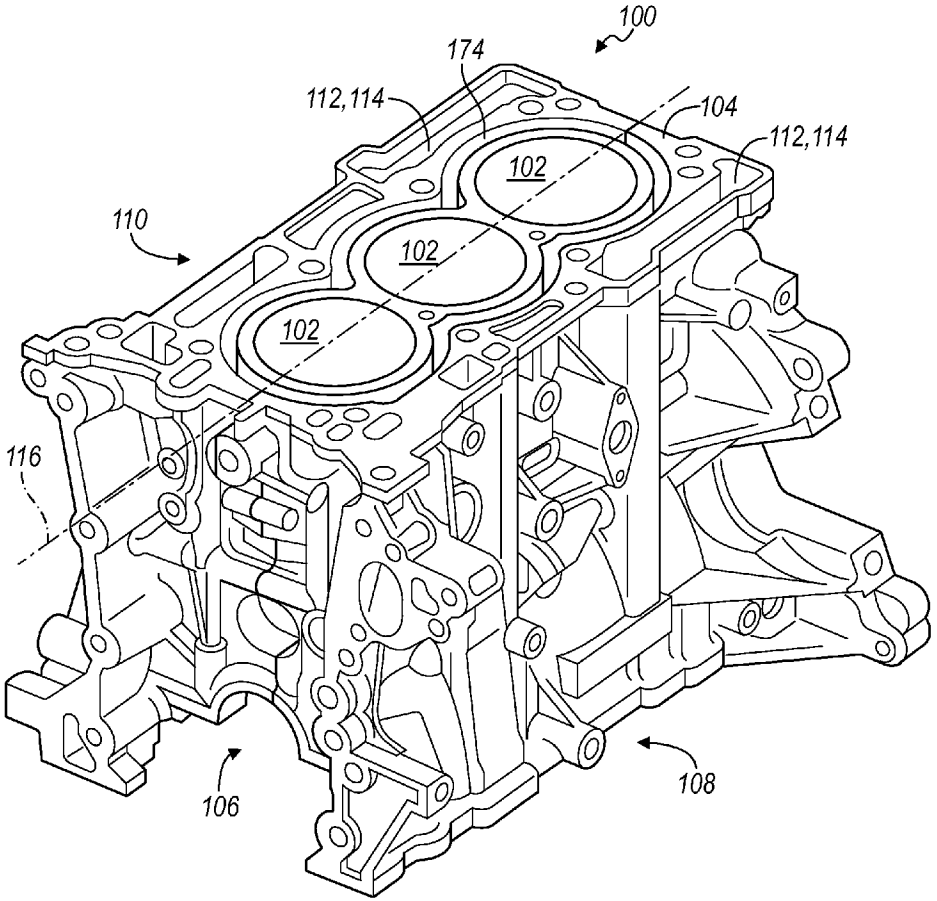
FIG. 2 illustrates a perspective view of a cylinder block of an engine according to an embodiment in an assembled configuration.

FIG. 2 illustrates a perspective view of a cylinder block 100 according to an embodiment. The cylinder block 100 may be used as block 60 with the engine 20 according to an example. The block 100 is formed from multiple components or elements that are individually formed and then assembled together to provide the structure of the block as described below. At least some of the components or elements are made from a composite material to provide a "composite" block. The cylinder block 100 is illustrated for use with an in-line, three cylinder engine, although other configurations are also contemplated. The block 100 is illustrated as having cylinders 102 arranged in a siamesed configuration according to a non-limiting example.

The engine block 100 is shown with a deck face 104 that is configured to mate with a corresponding deck face of a cylinder head 62 or a head gasket. The block 100 has attachment features to connect to the cylinder head 62 via head bolts or other fasteners.

A crankcase cover (not shown) may be provided and is connected to an end 106 of the block 100 to form the crankcase and generally enclose the crankshaft 36, contain lubricant, etc. The end 106 may be provided with a face or mating surface for the crankcase cover. The end 106 for the crankcase is generally opposed to the deck face 102 in the present example, as the crankshaft 36 is generally opposed to the cylinder head. The end 106 may also provide support structure for the crankshaft 36, crankshaft main bearings, etc.

The block 100 has an "intake side" or side 108 that is associated with the intake ports for the engine. The block also has an "exhaust side" or side 110 that is associated with the exhaust ports for the engine. Generally, the intake side 108 is opposed to the exhaust side 110.

The block 100 defines internal fluid passages 112 for a fluid jacket 114. The jacket 114 depicted in FIG. 2 is a cooling jacket. A fluid such as a coolant and/or a lubricant may be provided and circulated in the fluid jacket when the engine is assembled and in operation. The block 100 may have more than one jacket 114, such as a cooling jacket and a lubricating jacket, with different fluids in each respective jacket.

The block 100 and engine has a longitudinal axis 116. The longitudinal axis 116 may extend through the centerline of the each of the cylinders 102 such that the intake side 108 is on one side of the axis 116, and the exhaust side 110 is on the other side of the axis 116.

Figure 3:
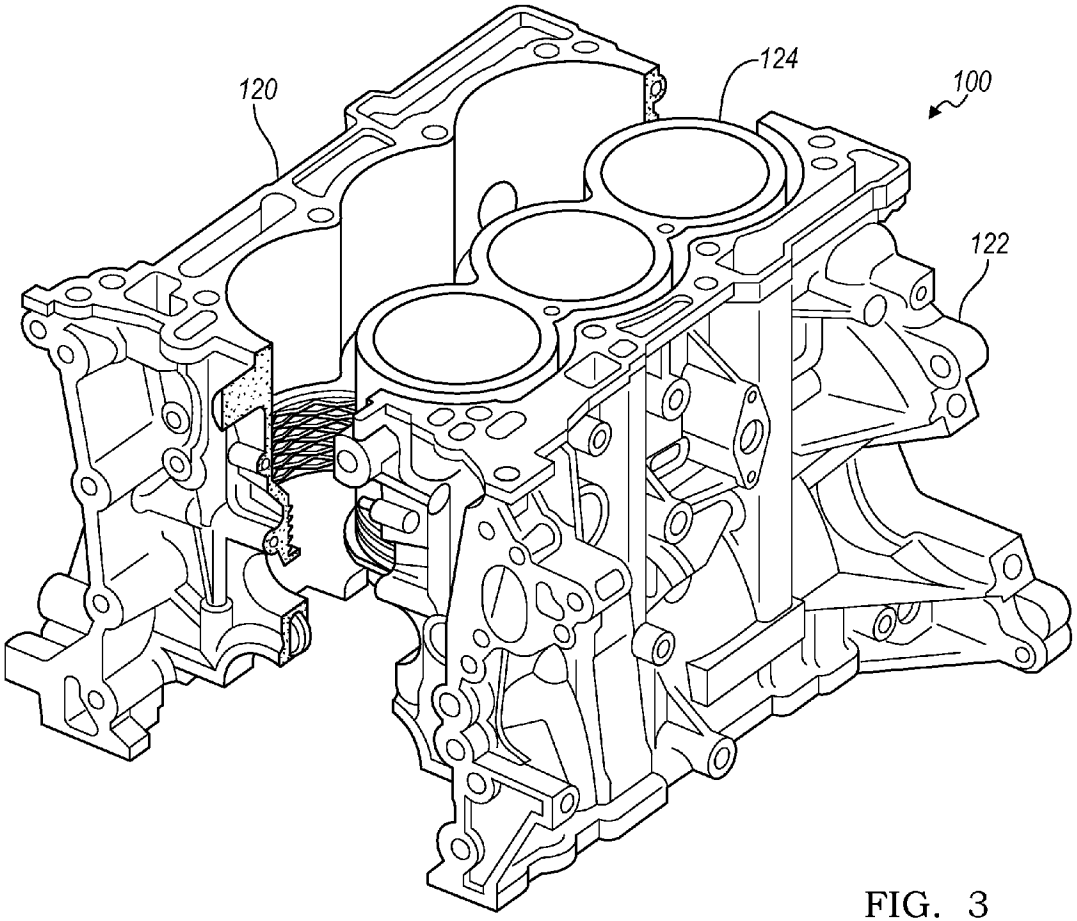
FIG. 3 illustrates a perspective view of the cylinder block of FIG. 2 in a disassembled configuration.

FIG. 3 illustrates an exploded view of the block 100 of FIG. 2, or illustrates the block 100 in a disassembled state. The block 100 has a first composite panel 120, composite component, composite shell, or composite portion. The block also has a second composite panel 122, composite component, composite shell, or composite portion. In the present example, the block 100 structure is primarily formed by only two composite panels. In other examples, any number of panels may be used.

A liner 124 for the cylinders 102 or bores of the engine is also provided and is positioned between the first and second panels 120, 122 and supported by the panels 120, 122. The liner 124 is illustrated as being a unitary component defining multiple bores; however, in other embodiments, more than one liner may be used with a block 100, and each liner may define one or more bores.

By using first and second panels 120, 122, detailed features may be molded into the block 100 without the need for set cores like a wax core or similar printed core to form the cooling jacket 114 for example. The parting lines or mating surfaces between the panels 120, 122 may be positioned to provide structural ribs in the block 100 to reduce powertrain bending, to mitigate noise, vibration, and harshness (NVH), and to improve manufacturing by simplifying tooling and reducing size.

The panels 120, 122 are designed with passages or regions of fluid containment for lubricant and coolant to prevent fluid leakage and fluid mixing leading to contamination. Additionally, features such as detailed internal windage and oil drainage scrapers may be molded into the crankcase walls at the end 106 of the block 100 to reduce frictional losses caused by suspended oil droplets and oil mist tossed off the rotating crankshaft assembly.

By sizing the panels 120, 122 appropriately, uniform mechanical properties may be provided for the block. The alloy cylinder insert is molded to fall within the resin/carbon fiber composite to mitigate the thermal expansion issue associated with dissimilar coefficient of thermal expansion. For example, the cylinder liner system is attached to and retained by the composite panels along the lower cylinder bore region. An adhesive or epoxy bond is applied to the joint faces of panels 120, 122. The liner may therefore thermally expand in the vertical direction with the top portion of the liner as a free standing element exposed to the head deck or partially contacting the panels 120, 122 with a connection at the deck while a surrounding water jacket separates the configuration.

By using a panelized composite block 100, the amount of material poured at one time is reduced compared to a one piece molding or casting, as the panels are formed separately. The present disclosure allows for improved control over the shape of the panels 120, 122 and enables complex shapes to be molding into the block. The structural panels 120, 122 are bonded together, which also may increase block strength and improved fluid containment and separation.

By forming the block 100 using panels 120, 122, each panel 120, 122 may have a more uniform cure rate. With a one piece molded block formed from a composite material, such as a carbon fiber composite, the cure rates for thin and thick sections differs, which may cause manufacturing issues. The panelized structure of the block 100 allows for more detailed fluid passages 112 than would be available with a one piece molded block.

Issues may also arise with a one piece molded block as the material properties between the liner and the composite block structure differ. For example, the thermal expansion coefficients between a metal liner and a composite block structure may differ sufficiently such that it is difficult to hold the liner while molding the composite resin/carbon fiber materials that make the connective structure of the physical shape of the cylinder block. By providing a panelized design according to the present disclosure, the components may be sized, formed, and assembled in a manner that avoids issues associated with the one piece molding.

Figure 4:
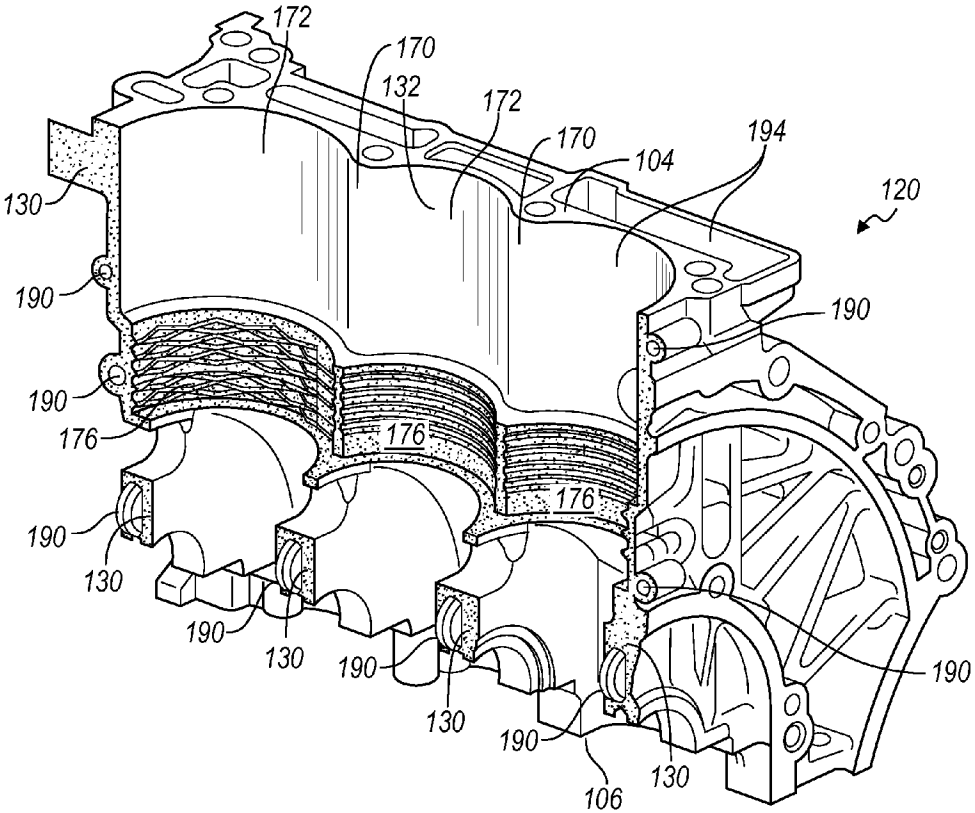
FIG. 4 illustrates a perspective view of a first composite panel of the block of FIG. 2.

The first composite panel 120 is illustrated in FIG. 4. The panel 120 has a first surface 130 associated with the block 100 parting line and adjacent to a first recess 132. The recess 132 defines a cavity that is sized and shaped to receive one side of the liner 124. The surface 130 generally or substantially surrounds the recess 132, e.g., along three sides of the recess 132. The surface 130 provides the parting line for the block 100. The surface 130 is defined by at least one plane, and in the example shown, the plane extends through the longitudinal axis 116 of the block 100 and through the liner 124 when the block 100 is assembled. In other examples, the surface 130 may be defined by multiple planes, inclines, contours, and complex surfaces to provide the parting line for the block. The surface 130 may be provided by multiple spaced apart surfaces as shown that lie in a common plane or in multiple planes.

The first composite panel 120 defines a portion of the deck face 104 and a portion of the crankcase 106. In one example, at least a portion of the first surface 130 is substantially perpendicular to the portion of the deck face 104 or at another angle relative to the deck face 104.

Figure 5:
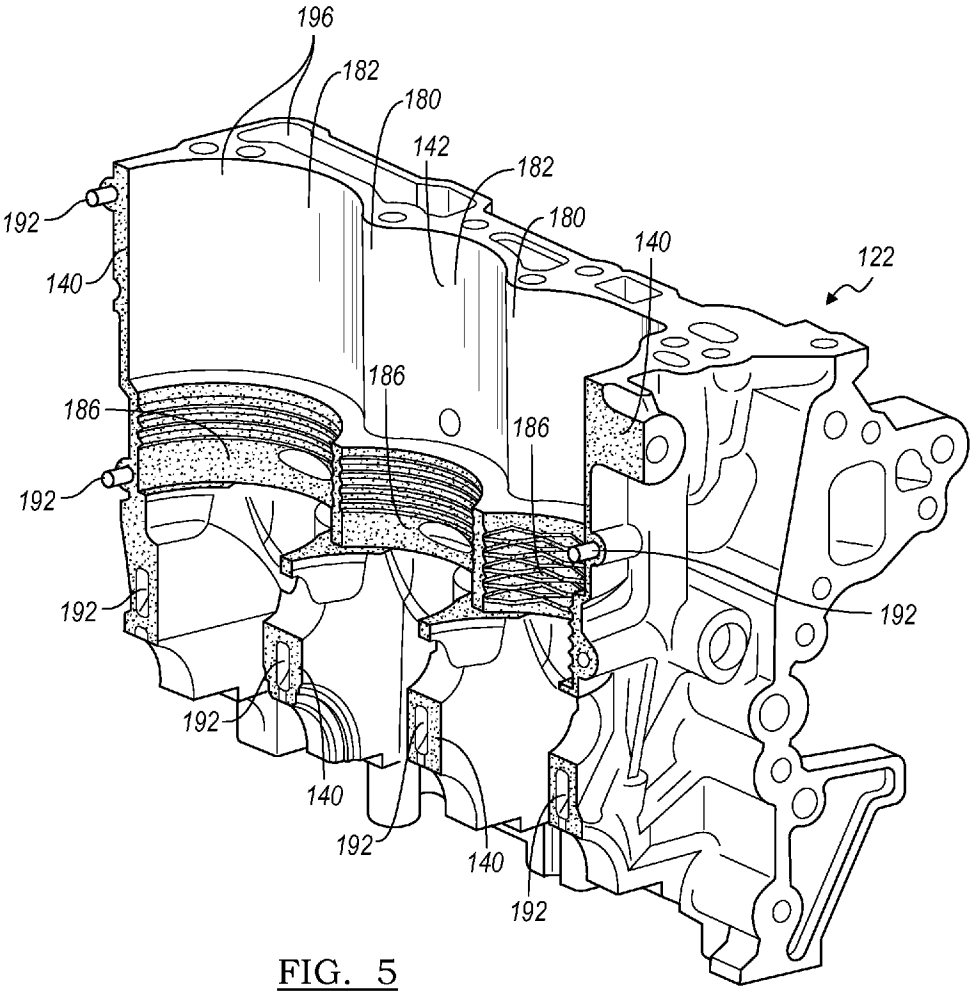
FIG. 5 illustrates a perspective view of a second composite panel of the block of FIG. 2.

The second composite panel 122 is illustrated in FIG. 5. The panel 122 has a second surface 140 associated with the block 100 parting line and adjacent to a second recess 142. The recess 142 defines a cavity sized and shaped to receive the other side of the liner 124. The surface 140 generally or substantially surrounds the recess 142, and provides the parting line for the block 100. The surface 140 is defined by at least one plane, and in the example shown, the plane extends through the longitudinal axis 116 of the block 100 and is the same plane(s) as for surface 130 of the first panel 120.

The second composite panel 122 defines another portion of the deck face 104 and another portion of the crankcase 106. The first and second panels 120, 122 cooperate to provide the deck face 104 and the end 106 for the crankcase.

As seen in FIG. 3, the liner 124 is positioned between the first and second panels 120, 122 and is received and surrounded by the first and second recesses 132, 142. The first surface 130 of the first panel 120 mates with the second surface of the second panel 122 when the block 100 is assembled to position and retain the liner 124 and form the block 100.

The first and second panels 120, 122 are formed from a composite material. In one example, the portions 120, 122 are formed from a material including carbon fiber. The panels 120, 122 may be formed from one or more composite materials. Examples of composite materials for use with the panels 120, 122 include up to 50% carbon fiber reinforced thermal set composite resin ester based or polyester based. The panels 120, 122 may have a uniform composition, or may be made with a non-uniform composition.

Figure 6:
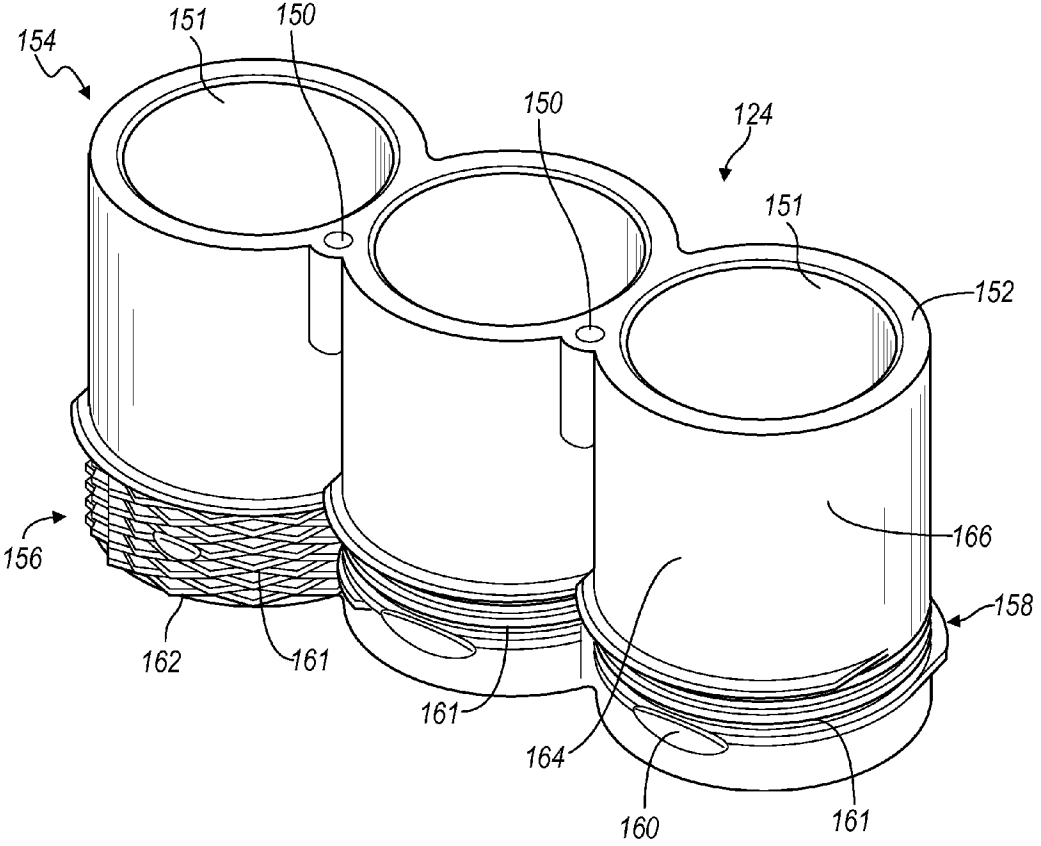
FIG. 6 illustrates a perspective view of a cylinder liner for the block of FIG. 2.

The liner 124 is illustrated in FIG. 6. The liner 124 may be a ganged liner for at least two adjacent or siamesed cylinders. In the example shown, the liner 124 is a ganged liner for three adjacent, siamesed cylinders, although any number of cylinders is contemplated. In other examples, the liner 124 may be provided for an individual cylinder, and an array of liners may be provided for use with the first and second portion in the block 100.

The liner 124 may be made from a material selected for its heat, friction, and/or wear resistance during engine operation. The liner 124 may be made from various metals or metal alloys, including iron, ferrous alloys, mixed metal alloys, etc. The liner 124 may additionally be coated, for example, with steel wire plasma coating (PTWA). The liner 124 may have various passages 150 formed therein, for example, in an interbore region, to provide for improved interbore cooling and thermal management. Inner surfaces 151 of the liner 124 provide the bore walls of the engine.

The liner 124 is positioned within the block 100 such that the upper edge 152 of the liner 124 is flush with the deck face 104. In other examples, the liner 124 and/or the deck face 104 may be machined after assembly to provide a planar surface.

The liner 124 has a first end region 154 and a second end region 156. The first end region 154 is adjacent to the deck face 104 of the block. The second end region 156 is internal to the block 100. The second end region 156 may have a series of projections 158 such as flanges, ribs, surface textures, and the like. Alternatively, the second end region 156 may have a series of grooves or other depressions 160 formed therein. The surface features 158, 160 on the liner 124 may also be macro-tribology surface features 161, and may include various specified roughnesses. In the example shown, the liner 124 has both projections 158 and depressions 160. The surface features 158, 160 may extend to a lower edge 162 of the liner 124 or may be spaced apart from the lower edge 162.

The liner 124 has a curved outer surface 166 based on the cylinders 102 and interbore regions. The first recess 132 of the first portion 120 has a corresponding curved surface to that of the liner 124. In the present example, the recess 132 has alternating convex surfaces 170 and concave surfaces 172 sized to receive the cylinder liner 124. The radius of curvature of the convex and concave surfaces 170, 172 of the recess 132 may differ from that of the outer surface 166 of the liner 124 such that a wall of the recess is spaced apart from an outer wall 164 of the liner 124, thereby forming a cooling channel 174 between the recess 132 and the liner 124, as shown in FIG. 2.

The first recess 132 has a surface or region 176 that forms a corresponding surface treatment such as a series of projections, depression, or other surface structure or texture to correspond with that of the liner 124. When the block 100 is assembled, the surface or region 176 of the recess is in contact with surface features 158, 160 of the liner 124, and the surface features provide for an increased contact area and an improved connection or coupling between the liner and the portion 120.

The second recess 142 of the second panel 122 also has a corresponding curved surface to that of the liner 124. In the present example, the recess 142 has alternating convex surfaces 180 and concave surfaces 182 sized to receive the cylinder liner 124. The radius of curvature of the convex and concave surfaces 180, 182 of the recess 142 may differ from that of the outer surface 166 of the liner 124 such that a wall of the recess is spaced apart from an outer wall 164 of the liner 124, thereby forming a cooling channel 174 between the recess 142 and the liner 124, as shown in FIG. 2.

The second recess 142 has a surface or region 186 that forms a corresponding surface treatment such as a series of projections, depression, or other surface structure or texture to correspond with that of the liner 124. When the block 100 is assembled, the surface or region 186 of the recess is in contact with the surface features 158, 160 liner 124, and the surface treatments provide for an increased contact area and an improved connection or coupling point between the liner and the panel 122.

The first panel 120 has a first series of locating features 190. The second panel 122 has a corresponding second series of locating features 192 sized and shaped to mate or cooperate with the first series of locating features 190 to align and position the first and second panels 120, 122 relative to one another when assembling the block 100. The locating features 190, 192 include male features, such as dowels, pins, pucks, and the like, and corresponding female features. The female features may be sized to be a close fit with the male features to reduce movement between the panels 120, 122. The locating features 190, 192 may be shaped to restrain the panels 120, 122 relative to one another in one or more degrees of freedom, and in the example shown, the locating features 190, 192 cooperate to constrain the portions 120, 122 relative to one another to prevent translation along the longitudinal axis, translation along a vertical axis, and also rotation relative to one another.

The locating features 190, 192 are illustrated as being directly adjacent to the respective mating 130, 140 surfaces of each panel. In other examples, at least some of the locating features 190, 192 may be spaced apart from the mating surfaces 130, 140.

The first panel 120 defines fluid passages 194 or portions of fluid passages. The second panel 122 also defines fluid passages 196 or portions of fluid passages. The fluid passages 194, 196 of the first and second panels cooperate with one another to form the fluid jacket 114 for the block 100.

An adhesive is provided on at least one of the first and second surfaces 130, 140, at least one of each set of corresponding locating features 190, 192, and on the first and second regions 176, 186 of the first and second recesses 132, 142. The adhesive connects the liner 124 to the first and second panels 120, 122 and connects the first and second panels 120, 122 to one another. The adhesive may be selected based on the composite material chosen for the block 100. Examples of the adhesive include two part epoxy compatible with ester based resin. The adhesive is applied to the panels 120, 122 in areas indicated by the shading pattern in FIGS. 4-5.

Figure 7:
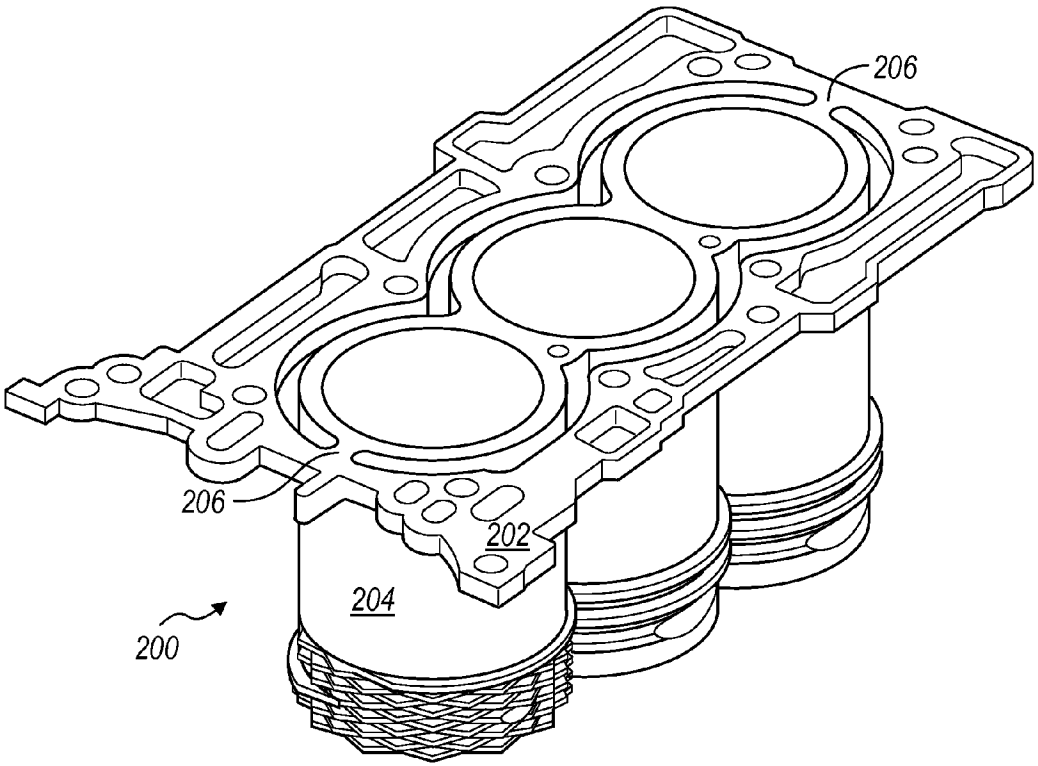
FIG. 7 illustrates a perspective view of another cylinder liner for the block of FIG. 2.

FIG. 7 illustrates another embodiment of a cylinder liner insert 200 for use with the block of FIG. 2. The liner 200 may be a ganged liner for at least two adjacent or siamesed cylinders. In the example shown, the liner 200 is a ganged liner for three adjacent, siamesed cylinders, although any number of cylinders is contemplated. In other examples, the liner 124 may be provided for an individual cylinder, or for an array of spaced apart liners. The insert 200 is provided with a generally planar member 202. The member 202 extends over the panels when the block is assembled to provide a portion of the deck face 104 of the block, or the entire deck face 104 of the block. The member 202 is shown as being attached to the liner portions 204 via bridges 206 or another structural connection. In other examples, the member 202 may be provided as a separate component compared to the liners 204 that are each individually connected and assembled with the panels to form the block. The member 202 is formed with various apertures and passages therethrough that provide for cooling passages and coolant flow, the connection of head bolts, and the like. The member 202 may provide for a closed deck face, open deck face, or semi-open deck face configuration for the block.

Figure 8:
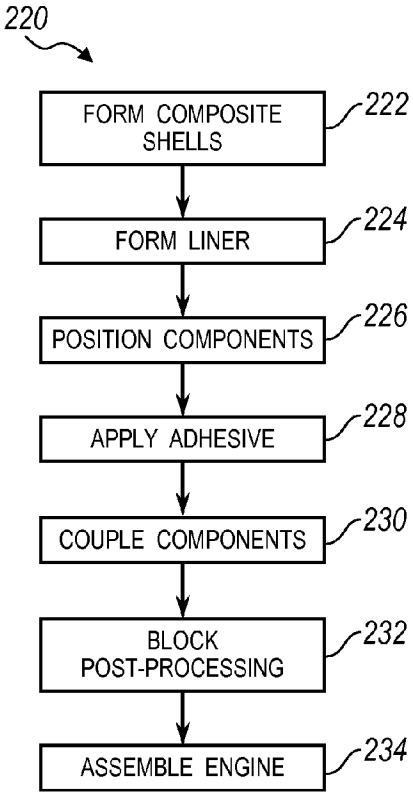
FIG. 8 illustrates a flow chart of a method of providing a composite cylinder block of an engine according to an embodiment.

FIG. 8 illustrates a process or a method 220 for forming and/or assembling a composite block for an engine, such as block 100. Various embodiments of the method 220 may include greater or fewer steps, and the steps may be performed in another order than illustrated.

The first and second composite panels or shells are formed at 222. The panels may be formed using a molding technique such as injection molding, etc. A mold is provided for each panel with the desired features. The mold is shaped to form the surfaces, recesses, locating features, fluid passages, etc. into the panel such that little or no post processing of the panel is needed. The molds are provided according to the manufacturing technique for the panels, and may include various dies, molds, slides, and the like. The molds may also include various inserts or cores to provide other features of the panels. During the molding process, an autoclave or the like may be used to cure the composite material. The molding process can be of an injection mold or compression mold both being thermal set at time of production.

A liner is formed at step 224, such as liner 124. The liner may be formed from a casting process such as sand casting or die casting. The liner may be cast from an iron or an iron alloy material. The liner may be cast using a near net shape casting process, and may be cast using a high pressure or low pressure process. The liner is formed with the surface features as described above, and in further examples, at least some of the surface features may be provided by a machining process or the like. In other examples, the liner may be formed using other appropriate manufacturing techniques, including, but not limited to, casting, powder metallurgy techniques, forging, machining, die casting and heat treating, etc. The internal surface of the liner is machined to form the surface for the cylinder wall of the engine.

At 226, the block components, e.g., the panels and liner, are positioned relative to one another for assembly into the block. In one example, the panels and the liner are positioned in a tool for assembling the block 100 such that the liner is positioned between the first and second panels as shown in FIG. 2.

At 228, adhesive is applied to the surfaces of the panels, the regions of the recesses, and/or the surface feature of the liner.

At 230, the locating features are aligned with one another and the panels are moved towards one another and coupled such that the first surface mates with the second surface and the liner is surrounded by and retained in the composite structure of the block. The liner is received by the first and second recesses and mates with a portion of the recesses while forming a fluid passage or channel with another portion of the recesses. The male locating features are received by the female locating features. A pressure may be applied to force the panels together until the adhesive sets or cures. The adhesive or epoxy may be self-curing in an exothermic process.

At 232, the block 100 may be machined or otherwise post-processed. For example, the block 100 may be machined or milled to form the deck face 104, etc. Additionally, the block 100 may be machined, or drilled and tapped, to form attachment points for head bolts, main bearing cap fasteners, etc.

At 234, the engine 20 is assembled by connecting the cylinder head and the crankcase cover to the block, and the engine 20 may be placed into a vehicle.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A cylinder block comprising:

a first composite panel having a first surface adjacent to a first recess, the first recess defining at least one depression extending outwardly from the first recess in a radial direction;

a second composite panel having a second surface adjacent to a second recess;

a ganged cylinder liner of at least two adjacent cylinders received by the first and second recesses and positioned between the first and second panels, the liner having a first end region and a second end region, the first end region adjacent to a deck face of the block, and the second end region defining at least one projection extending along an outer surface of the liner;

wherein the first surface is adapted to mate with the second surface along a plane extending through the liner and along a block longitudinal axis;

wherein the first recess of the first panel has a convex surface positioned between adjacent concave surfaces sized to receive the liner;

wherein the second recess of the second panel has a convex surface positioned between adjacent concave surfaces sized to receive the liner; and wherein the at least one depression of the first recess of the panel is sized to receive at least a portion of the at least one projection on the second end region of the liner thereby locating the liner relative to the first panel in an axial direction.

2. The block of claim 1 wherein the first and second composite panels comprise carbon fiber; and wherein the cylinder liner comprises a metal.

3. The block of claim 1 wherein the first composite panel forms a portion of a deck face and a portion of a crankcase opposed thereto, the deck face configured to mate with at least one of a head gasket and a cylinder head deck face.

4. The block of claim 3 wherein the first surface of the first composite panel is substantially perpendicular to the portion of the deck face.

5. The block of claim 1 wherein the cylinder liner has a planar member extending outwardly and forming a deck face such that the first and second panels are positioned beneath and covered by the planar member.

6. The block of claim 1 wherein a surface of the first recess is in contact with a portion of an outer surface of the cylinder liner; and wherein a surface of the second recess is in contact with an opposed portion of the outer surface of the cylinder liner.

7. The block of claim 1 wherein the second recess of the second panel defines at least one depression extending outwardly from the second recess in a radial direction and sized and shaped to receive another portion of the at least one projection of the liner.

8. The block of claim 1 wherein the first end region of the liner is adjacent to a deck face of the block, the deck face configured to mate with at least one of a head gasket and a cylinder head deck face, wherein the first end region of the liner is spaced apart from the recess of the first panel and the recess of the second panel about a circumference of the first end region of the liner to define a fluid passage continuously intersecting the deck face and continuously circumferentially surrounding the liner.

9. The block of claim 1 wherein the first panel has a first series of locating features;

wherein the second panel has a second series of locating features; and wherein the first series of locating features cooperate with the second series of locating features to position the first panel relative to the second panel.

10. The block of claim 8 wherein the first panel comprises at least one internal fluid passage spaced apart from the first recess;

wherein the second panel comprises at least another internal fluid passage spaced apart from the second recess; and wherein the at least one internal fluid passage and the at least another fluid passage cooperate to form a fluid jacket for the block.

11. A method of forming a composite cylinder block comprising:

applying adhesive to a first surface and a portion of a first recess adjacent to the first surface of a first composite panel;

applying adhesive to a portion of a second recess adjacent to a second surface of a second composite panel;

positioning a ganged cylinder liner between the first and second composite panels, the liner having an upper end region and a lower end region; and coupling the first and second composite panels to one another such that the cylinder liner is received by the first and second recesses with the upper end region of the cylinder spaced apart from the adjacent first and second recesses to define a fluid passage continuously circumferentially surrounding the liner and continuously intersecting a deck face of the block formed by the first and second panels, the deck face configured to mate with at least one of a cylinder head gasket and a cylinder head deck face, the first surface mating with the second surface along a plane extending along a longitudinal axis of the block, and the portion of the first recess and the portion of the second recess mating with the lower end region of the liner.

12. The method of claim 11 further comprising:

molding the first composite panel; and molding the second composite panel.

13. The method of claim 12 wherein molding the first composite panel includes molding internal fluid passages for a fluid jacket; and wherein molding the second composite panel includes molding internal fluid passages for the fluid jacket; and wherein the internal fluid passages of the first and second panels are spaced apart from the first and second recesses, respectively.

14. The method of claim 11 further comprising forming the liner via a casting process such that the liner has a first end region with a first outer diameter and a second end region with a second outer diameter, the second outer diameter greater than the first outer diameter; and wherein coupling the first and second composite panels to one another such that the cylinder liner is received by the first and second recesses includes the second end region of the liner contacting the portion of the first recess and the portion of the second recess such that the first end region is spaced apart from the first and second recesses to form the fluid passage therebetween.

15. The method of claim 11 further comprising aligning the first composite panel with the second composite panel by inserting a male locating feature on one of the first and second composite panels into a female locating feature on the other of the first and second composite panels.

16. An engine comprising:

a cylinder block having first and second composite panels supporting a ganged cylinder liner forming adjacent cylinder bores extending along a block longitudinal axis, the first and second panels mating along a plane extending along the longitudinal axis and through the liner, the first and second panels cooperating to define a fluid passage continuously surrounding the liner and continuously intersecting a block deck face configured to mate with a head deck face.

17. The block of claim 5 wherein the planar member defines head bolt apertures extending therethrough.

18. The engine of claim 16 wherein the liner defines a first locating feature extending radially on the liner and positioned adjacent to a lower edge of the liner; and wherein the first panel defines a second locating feature extending radially; and wherein the first and second locating features are configured to mate with one another and fix the liner relative to the first panel in an axial direction.

19. The engine of claim 18 wherein the first locating feature is one of a projection and a depression; and wherein the second locating feature is the other of the projection and the depression.

20. The engine of claim 18 wherein the first locating feature is a combination of projections and depressions, and wherein the second locating feature is another combination of projections and depressions.

* * * * *